US008082848B2

(12) United States Patent
Hlavacek et al.

(10) Patent No.: US 8,082,848 B2
(45) Date of Patent: Dec. 27, 2011

(54) MISSILE WITH SYSTEM FOR SEPARATING SUBVEHICLES

(75) Inventors: Gregg J. Hlavacek, Tucson, AZ (US); Nigel B. Flahart, Tucson, AZ (US); David A. Adang, Tucson, AZ (US); Andrew D. Facciano, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 586 days.

(21) Appl. No.: 12/255,874

(22) Filed: Oct. 22, 2008

(65) Prior Publication Data

US 2010/0276544 A1 Nov. 4, 2010

(51) Int. Cl.
*F42B 12/58* (2006.01)

(52) U.S. Cl. ..... 102/489; 102/377; 102/378; 244/173.3

(58) Field of Classification Search ..... 102/489, 102/377–378; 89/1.14; 244/137.4, 173.3, 244/173.1

See application file for complete search history.

(56) References Cited

U.S. PATENT DOCUMENTS

| | | | | |
|---|---|---|---|---|
| 4,688,486 | A | 8/1987 | Hall et al. | |
| 4,929,135 | A | 5/1990 | Delarue et al. | |
| 5,318,255 | A | 6/1994 | Facciano et al. | |
| 5,361,676 | A | 11/1994 | Gibbs | |
| 5,370,343 | A | 12/1994 | Hornyak | |
| 5,671,650 | A | 9/1997 | Aubret | |
| 6,289,818 | B1 | 9/2001 | Mueller et al. | |
| 6,454,214 | B1 | 9/2002 | Smith | |
| 6,672,220 | B2 * | 1/2004 | Brooks et al. | 102/489 |
| 7,114,683 | B2 | 10/2006 | Hall | |
| 7,188,558 | B2 | 3/2007 | Brede et al. | |
| 7,445,183 | B2 * | 11/2008 | Koehler | 244/158.1 |
| 7,494,090 | B2 * | 2/2009 | Leal et al. | 244/3.16 |
| 7,578,482 | B2 * | 8/2009 | Duden | 244/171.7 |
| 2006/0027083 | A1 * | 2/2006 | Lee et al. | 89/1.14 |
| 2007/0074636 | A1 | 4/2007 | Rieger et al. | |

FOREIGN PATENT DOCUMENTS

| | | |
|---|---|---|
| EP | 0114901 | 8/1984 |
| EP | 1739384 | 1/2007 |
| FR | 2557286 | 6/1985 |
| WO | 2008054848 | 5/2008 |

* cited by examiner

*Primary Examiner* — Michael Carone
*Assistant Examiner* — Michael D David
(74) *Attorney, Agent, or Firm* — Renner, Otto, Boisselle & Sklar, LLP

(57) ABSTRACT

A missile includes several subvehicles that are initially mechanically coupled to a missile main body, and a separation system for separating the subvehicles from the missile main body. The separation system has a single triggering mechanism to simultaneously provide energy to separate all of the subvehicles. This advantageously provides only a single shock to the system by actuating the system to separate the subvehicles. By limiting the shocks to the single shock of actuating the energy system and the shocks of the mechanical disengagement of the individual subvehicles, the disengagement system has improved performance. The subvehicles may be separated from the main body in radial directions substantially perpendicular to a central axis of the main body. This may provide for smoother disengagement, with less tipping, and may provide for greater, more uniform spacing between the disengaged subvehicles.

25 Claims, 9 Drawing Sheets

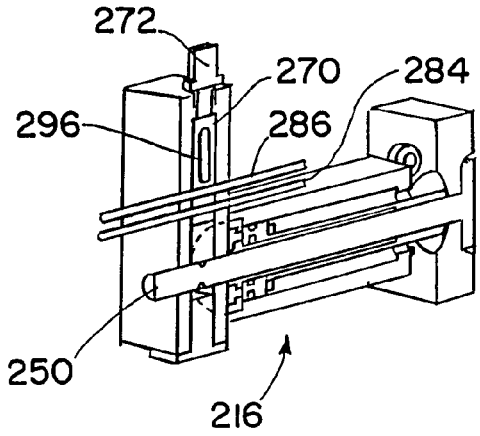
FIG. 17
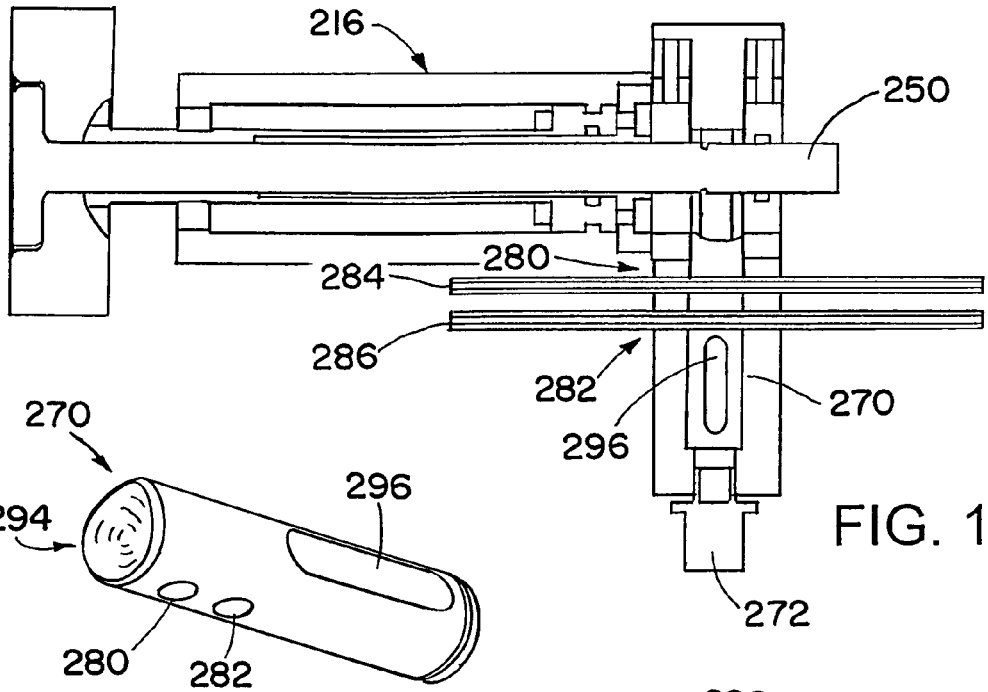
FIG. 18
FIG. 19
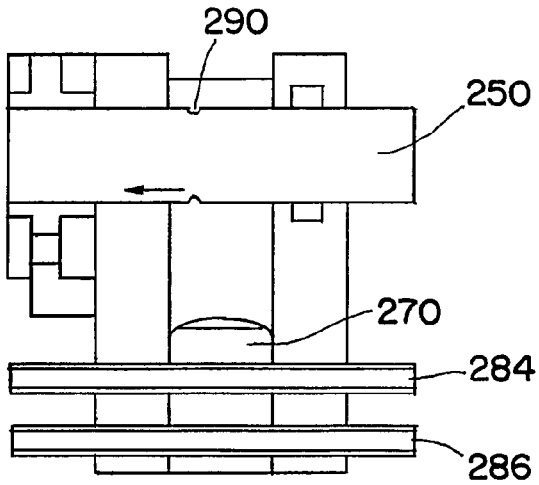
FIG. 20

MISSILE WITH SYSTEM FOR SEPARATING SUBVEHICLES

BACKGROUND OF THE INVENTION

1. Technical Field of the Invention

The invention is in the field of separation systems for separating subvehicles from missiles or spacecraft.

2. Description of the Related Art

Various systems have been used to separate subvehicles from a missile or spacecraft during flight. Among the mechanisms utilized in such systems have been all lock mechanisms, springs, inflatable bladders, severable clamping straps, and rotation of all or parts of the missile or spacecraft. Shortcomings of these methods have included undesirable heaviness, complexity, and large shock loads to the subvehicles, as well as difficulty in integrating with other systems. Therefore it would be advantageous to have improvements in this area.

SUMMARY OF THE INVENTION

A separation mechanism for separating subvehicles from a spacecraft or missile includes an integrated mechanism for disconnecting, releasing, and ejecting said subvehicles. The unified or integrated mechanism reduces weight and shock loads, relative to prior systems with separate mechanisms for disconnecting electrical, fiber optic, and/or cryo lines, releasing the subsystem, and ejecting it to a desired velocity. Each subvehicle may have a single pyrotechnic device or other gas-generating device that moves a cutter to sever cryogenic lines and mechanical coupling, and also activates a piston to push the subvehicle away from the main missile body. By using a single pyrotechnic device or other gas generating device to separate a subvehicle from the main missile body, as well as sever cryogenic lines coupling the two, shocks on the subvehicle are reduced. This leads to improved performance. In addition, the system may eject a subvehicle in a direction substantially perpendicular to an axis of the subvehicle and/or substantially perpendicular to an axis of the main missile body, leading to an improved spacing of the subvehicles. For example, the subvehicles may be spaced on a wider footprint than for prior systems.

According to an aspect of the invention, a separation system includes a single integrated device that both mechanically decouples a subvehicle from a main body, and detaches cryogenic lines running between the subvehicle and the main body.

According to another aspect of the invention, a single separation system provides full separation between a subvehicle and a main body with a reduced number of shocks, for instance no more than two shocks. One of the shocks may occur from activating a pyrotechnic or other gas-generating system, and the other shock may occur from severing or otherwise decoupling substantially all the connections between a subvehicle and a main body.

According to yet another aspect of the invention, a separation system for separating subvehicles from a missile body may include a pyrotechnic device that uses pressurized gas to sever a mechanical connection between the subvehicle and the main body, and to extend a piston to provide a force to push the subvehicle away from the main missile body.

According to still another aspect of the invention, a separation system for separating a subvehicle from a main body includes a pressure-driven cutter for severing, cleaving, or otherwise separating a mechanical connecting member and/or other structures between the subvehicle and the main body.

The mechanical connecting member may be a solid or hollow retention rod that initially mechanically couples the main body and the subvehicle together.

According to a further aspect of the invention, a missile includes: a missile main body; one or more subvehicles initially mechanically coupled to the main body; cryogenic lines connecting the missile main body and the subvehicles; and a separation system that enables selective decoupling during flight of the one or more subvehicles from the main body. The separation system includes one or more pressurized gas sources that use pressurized gas both to mechanically decouple the one or more subvehicles from the missile main body and to disconnect the lines from the missile main body and eject the subsystem at a desired velocity.

According to a still further aspect of the invention, a missile includes: a missile main body; one or more subvehicles initially coupled to the main body; and a separation system that enables selective decoupling, during flight, of the subvehicles from the main body. The separation system includes one or more pressure-driven cutters for severing mechanical couplings between the subvehicles and the main body.

According to another aspect of the invention, a missile includes: a missile main body; multiple subvehicles initially coupled to the main body; and a separation system that enables selective decoupling during flight of the subvehicles from the main body. The separation system includes a single pressurized gas source that provides a single shock in the process of separating the subvehicles.

According to yet another aspect of the invention, a method of separating subvehicles of a missile from a missile main body includes the steps of: disconnecting cryogenic lines connecting the missile main body and the subvehicles, using pressurized gas from one or more pressurized gas sources; and mechanically decoupling and separating the subvehicles from the missile main body, using the pressurized gas.

According to an embodiment of the invention, aspects described above and below may have one or more of the following features: a separation system includes a single pressurized gas source or pyrotechnic gas generator for decoupling and separating all of the subvehicles; alternatively, each of the subvehicles is separated by a different pressure source; a separation system uses a piston, driven by pressurized gas, to push a subvehicle away from a main missile body; the piston moves within a space between a piston cylinder and a piston sleeve; a piston vent is used to communicate pressurized gasses, to move the piston; the piston presses against a fitting on the subvehicle; the actuation of the separation is caused by severing a retention rod with a cutter or actuating a ball lock or segment lock, or releasing any locking system, using the same pressurized gases that move the piston to cause separation; the piston is retained with the missile main body after separation; the piston may have multiple segments, which may initially be stacked or nested within each other, and which may move relative to one another under influence of the pressurized gases, to expand the piston and push away the subvehicle; the subvehicle may have a fitting which fits inside the piston; this fitting may have ramped surfaces on a protruding lip, which urge balls into a piston groove on an inner surface of the piston; a cutter may be driven by pressurized gas to sever a retention rod and/or cryogenic lines; the cutter may have a concave cutting surface; the retention rod may have a notched surface; the notched surface may have a V shape, or a scalloped shape, for example having a semicircular cross-section; a pressurized gas source, such a pyrotechnic device, is detonated, producing pressurized gases that drive a cutter that severs or otherwise disconnects a mechanical coupling (for example including a retention rod) and/or cryogenic lines, the pressurized gases also move a piston to push a subvehicle away from a main missile body, with the piston for example pushing on a piston of the subvehicle; a piston may extend perpendicular to an eject direction, in conjunction with a lever to transfer the piston extension direction to a desired ejection direction (this allows more compact packaging of the piston next to the subvehicle); a passive cryogenic line disconnect (the line simply pulls away from the ejection); an actuated cryogenic line disconnect (by use of a pressure source); a passive connector disconnect for electrical connectors, fiber optic connectors, etc.; an actuated connector disconnect (using pressure source to actuate disconnection).

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale:

FIG. 17 is a cross-sectional view of part of still another embodiment separation system in accordance with the present invention;

FIG. 18 is a cross-sectional view of the separation system part of FIG. 17;

FIG. 19 is an oblique view of a cutter of the separation system of FIG. 17;

FIG. 20 is a cross-sectional view of part of the separation system of FIG. 17.

DETAILED DESCRIPTION

A missile includes several subvehicles that are initially mechanically coupled to a missile main body, and a separation system for separating the subvehicles from the missile main body. The separation system has a single triggering mechanism to simultaneously provide energy to separate all of the subvehicles. This advantageously provides only a single shock to the system by actuating the system to separate the subvehicles. By limiting the shocks to the single shock of actuating the energy system and the shocks of the mechanical disengagement of the individual subvehicles, the disengagement system has improved performance. The mechanical coupling between the subvehicles and the main body may be provided by retentions rods that are severed during the separation process. The severing of the retention rods may be accomplished at the same time as the severing of cryogenic lines linking the main body and subvehicles. The subvehicles may be separated from the main body in radial directions substantially perpendicular to a central axis of the main body. This may provide for smoother disengagement, with less tipping, and may provide for greater, more uniform spacing between the disengaged subvehicles.

Figure 1:
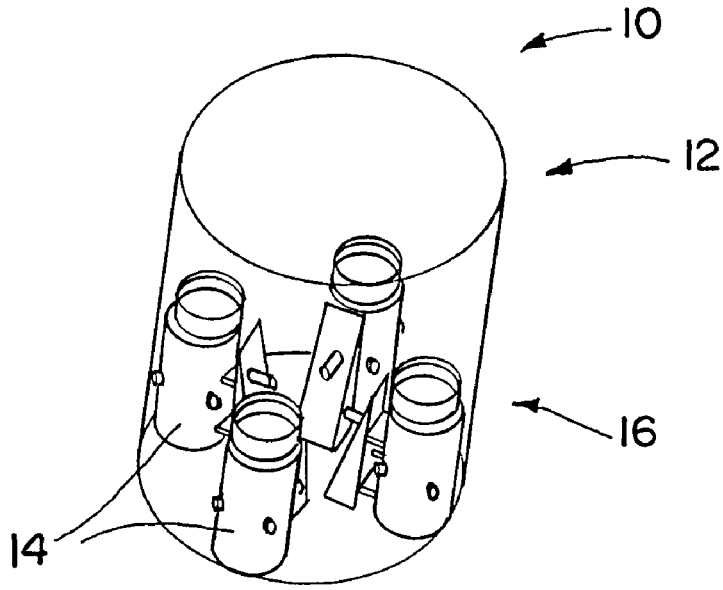
FIG. 1 is an oblique view of part of a missile in accordance with an embodiment of the present invention.

Referring initially to FIG. 1, a missile 10 includes a main missile body 12. A nose portion of the missile body 12 is shown in the figure, and it will be appreciated that missile body 12 also houses and includes a variety of other systems, such as propulsion systems, guidance systems, and communication systems.

The main body 12 has a number of subvehicles 14 initially within it and initially mechanically and operatively coupled to the main body 12. A separation system 16 is used for selectively separating the subvehicles 14 from the main body 12. The subvehicles 14 may be separated to increase chances of intercepting a target, such as an enemy missile or projectile. The subvehicles 14 may be separated from the main body 12 in radial directions 18 substantially perpendicular to a central axis 19 of the main body 12.

The missile 10 may be a space vehicle, used for intercepting targets at a high altitude or in space. The subvehicles 14 may be initially coupled to the main body 12 by electrical connections and cryogenic lines. The cryogenic lines may be used to cool systems in the subvehicle 14, such as optical systems including seekers for acquiring targets and guiding the subvehicles 14 to one or more targets.

Various configurations of the separation system 16 are described below. The separation system 16 mechanically decouples the subvehicles 14 from the missile main body 12. In addition the separation system 16 must disconnect electrical connections and cryogenic line connections between the subvehicles 14 and the missile main body 12. In doing so it is desirable to minimize the number and magnitude of shocks (brief surges in force) on the subvehicles 14. Further, it is desirable to separate the subvehicles 14 in a smooth manner that maintains their general orientation, without undue tipping or other changes in direction in the subvehicles 14, and it is desirable for the subvehicles 14 to be evenly dispersed over a desired area.

Figure 2:
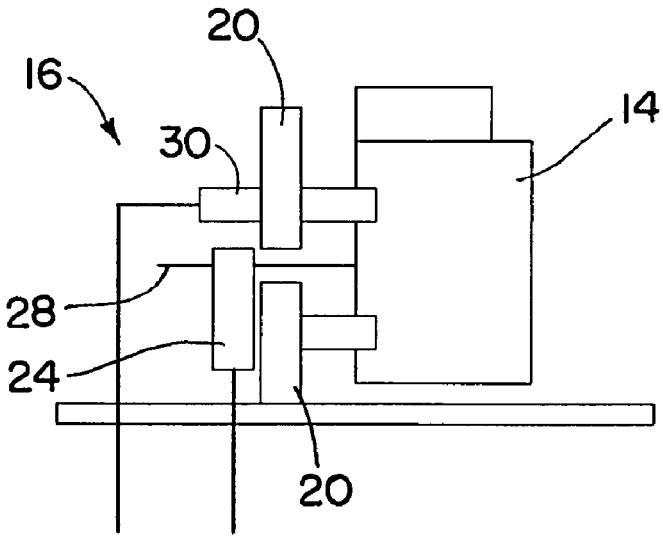
FIG. 2 is a conceptual diagram illustrating connections of a subvehicle in accordance with an embodiment of the present invention.

FIG. 2 schematically illustrates what is required for the separation. The subvehicle 14 is initially coupled to a mounting bracket 20. Pressurized gas is used to operate a cutter 24, to cause the cutter 24 to sever cryogenic lines and a mechanical restraint, collectively shown as reference number 28. Pressurized gas may also be used to operate a pneumatic piston 30, to push the subvehicle 14 outward and away from the mounting bracket 20.

Figure 3:
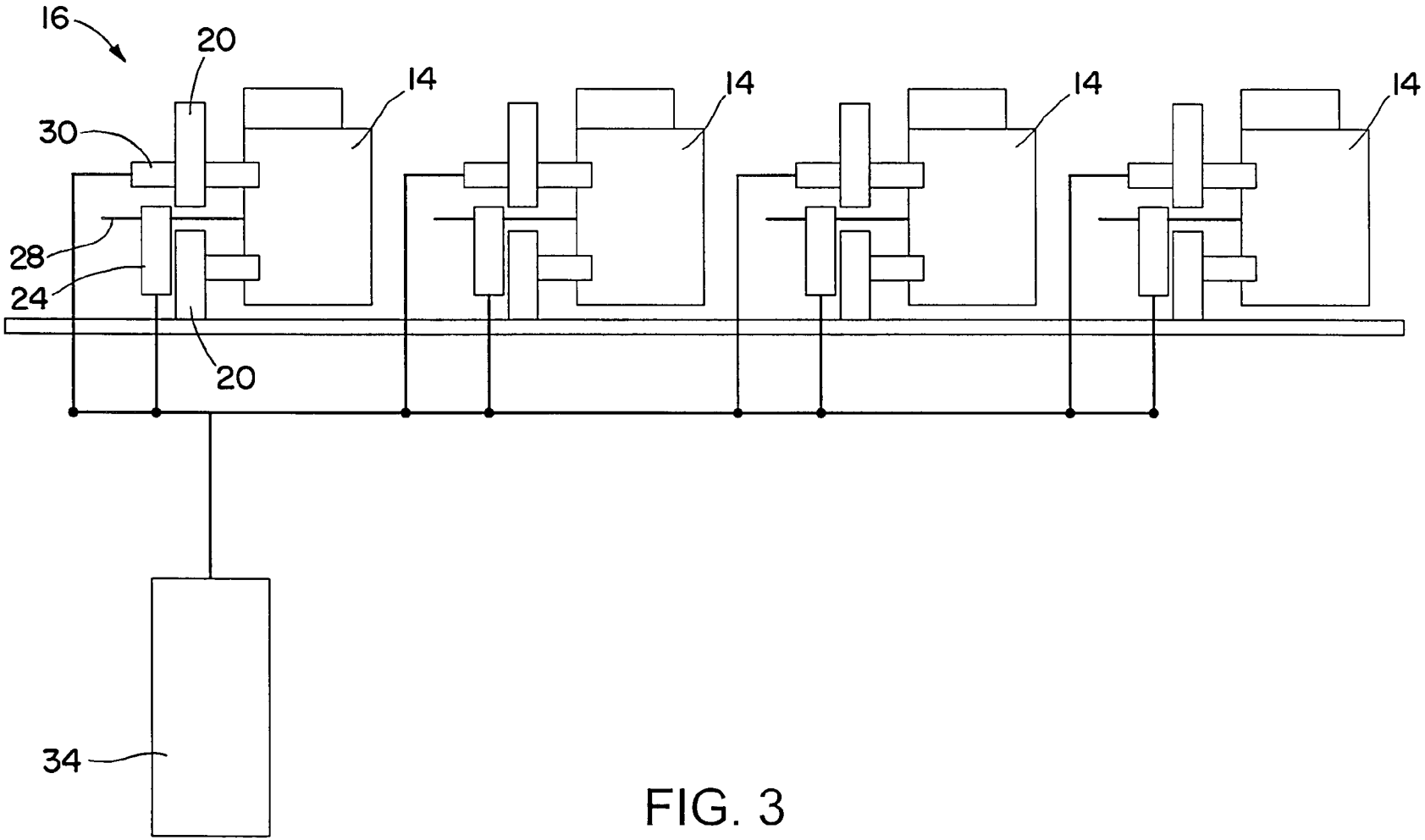
FIG. 3 is a conceptual diagram illustrating use of a single pressure source for separating multiple subvehicles.
Figure 4:
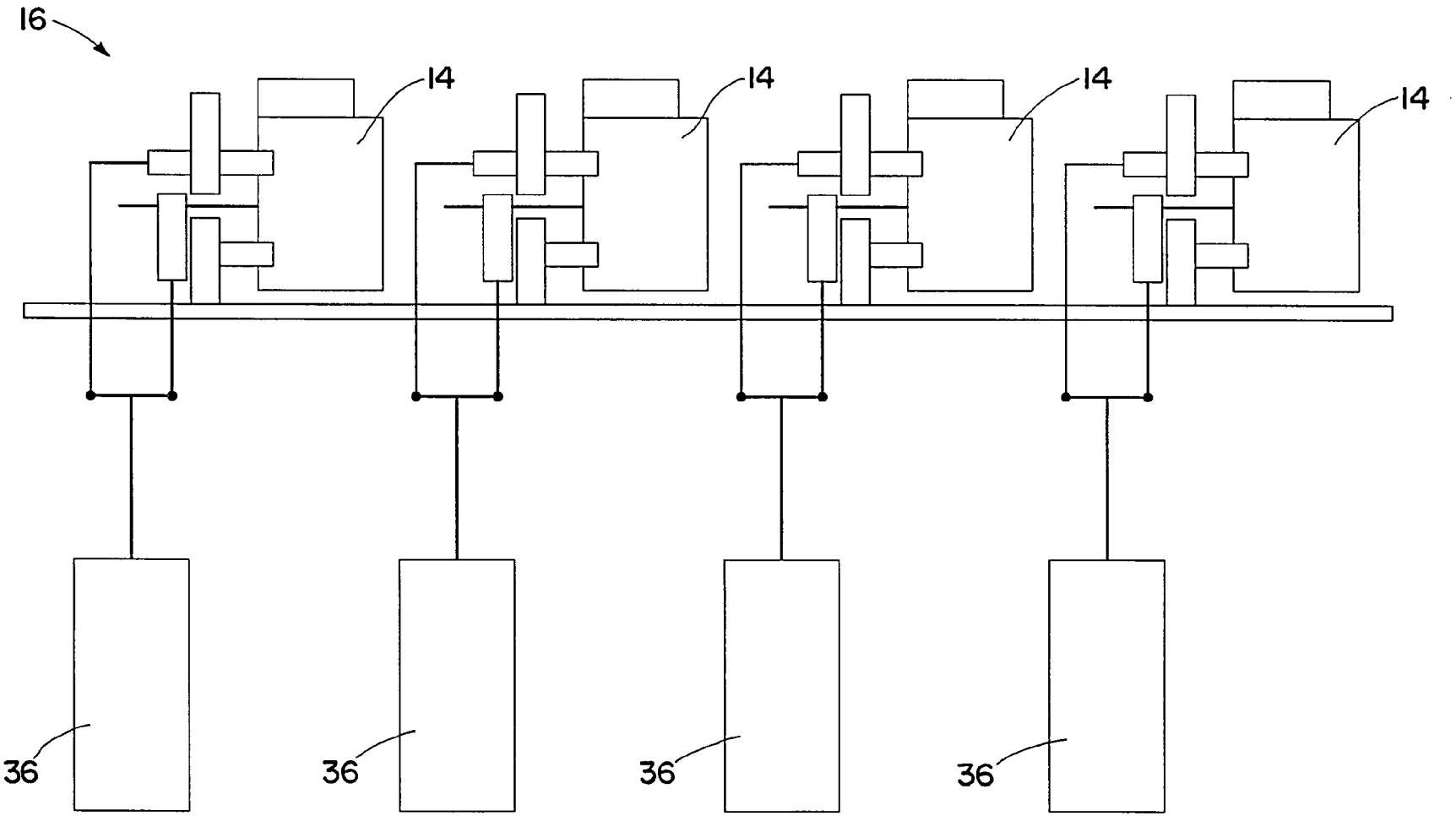
FIG. 4 is a conceptual diagram illustrating the use of separate pressure sources for separating multiple subvehicles.

FIGS. 3 and 4 schematically illustrate two possibilities for the configuration of pressure sources to accomplish the cutting and separating described above with regard to FIG. 2. In FIG. 3 a single pressure or energy source 34 (also referred to herein as a "pressurized gas source") is used to operate all of the cutters 24 and all of the pneumatic pistons 30, to separate all of the subvehicles 14. In FIG. 4 there are individual pressurized gas sources 36 corresponding to each of the subvehicles 14.

The pressurized gas sources 34 and 36 may be any of a variety of suitable sources. Examples include pyrotechnic charges used as a gas generator, and a pressure vessel such as a cryogenic bottle that has pressurized gas in it.

Figure 5:
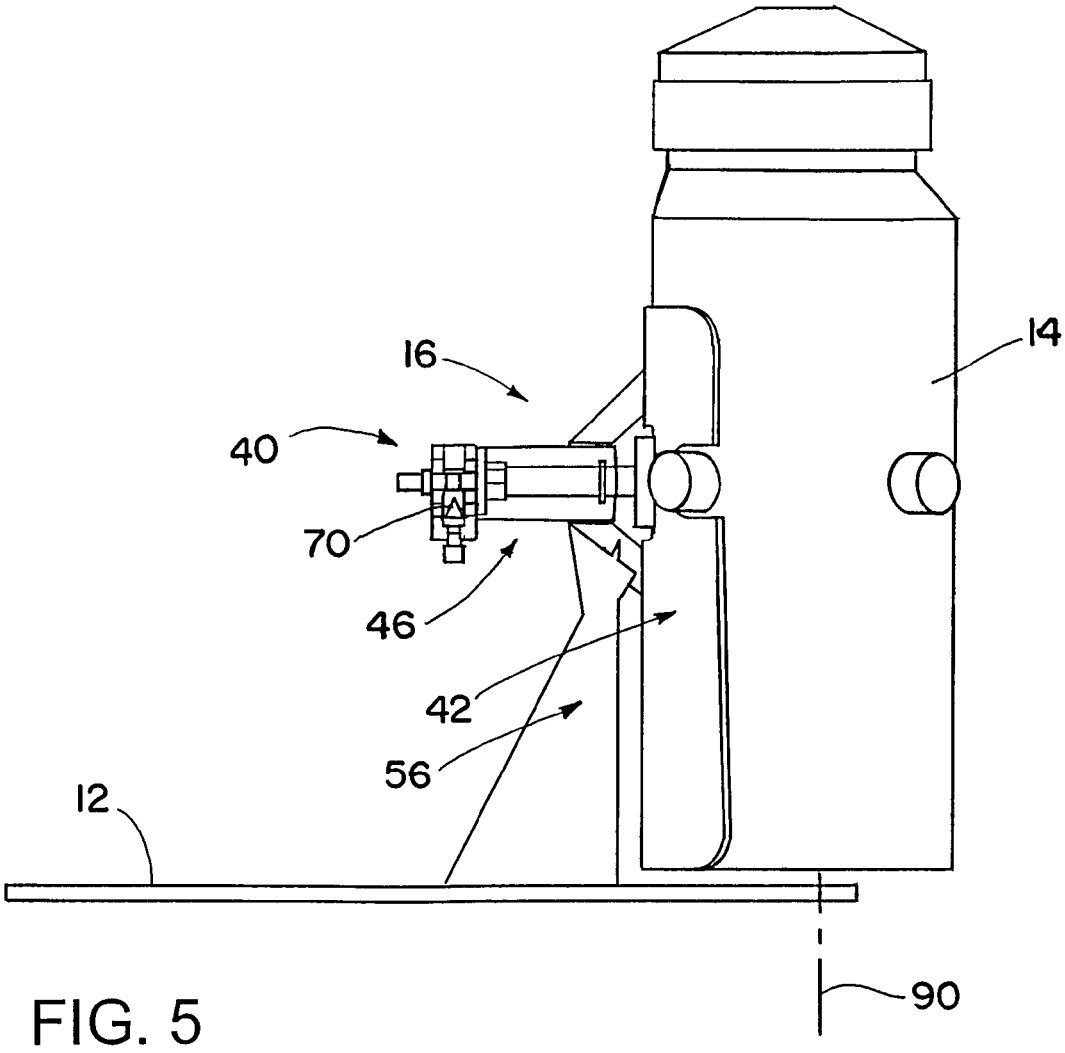
FIG. 5 is a side view of a portion of a separation system in accordance with an embodiment of the present invention.
Figure 6:
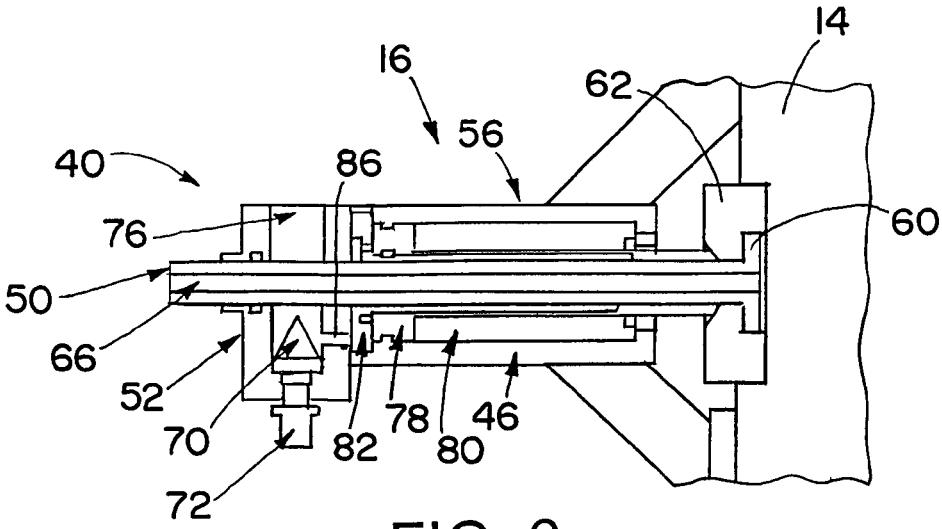
FIG. 6 is a cross-sectional view of the portion of the separation system shown in FIG. 5.

FIGS. 5 and 6 show a portion of one embodiment of the separation system 16. The separation system 16 includes a retention mechanism 40 for initially maintaining the subvehicle 14 against a subvehicle support 42 that is part of the main missile body 12. The separation system 16 also includes a pneumatic ejection mechanism 46 for pushing the subvehicle 14 away from the main missile body 12 after the retention mechanism 40 is disengaged.

The retention mechanism 40 includes a retention rod 50 that mechanically couples the subvehicle 14 to the main missile body 12. One end the retention rod 50 is secured to a cutter housing 52 that in turn is secured to an ejection mechanism support 56 of the main missile body 12. At the opposite end the retention rod 50 has a flange 60 that is secured within a bracket 62 of the subvehicle 14. The retention rod 50 has a central cryogenic line pass-through hole 66. The hole 66 allows cryogenic lines to pass through the retention rod 50 for coupling a cryogenic system of the main missile body 12 to devices in the subvehicle 14 that require cryogenic temperatures.

As will be explained in greater detail below, the retention rod 50 and the cryogenic lines may be severed by a cutter 70 that is driven into and through the retention rod 50 by detonation of a pyrotechnic device or system 72, an example of a pressurized gas source. The pyrotechnic device 72 also provides pressurized gas for operation of the ejection mechanism 46. An anvil 76 provides a stop for the cutter 70.

The ejection mechanism 46 includes an eject piston 78 that is between a piston cylinder 80 and a piston sleeve 82. The piston sleeve 82 surrounds the retention rod 50, and allows a portion of the rod 50 to slide relative to the sleeve 82 as the submunition 14 is separated in the missile main body 12. A piston vent 86 in the cutter housing 52 provides a conduit for introducing pressurized gases from the pyrotechnic system 72 into the space between the piston cylinder 80 and the piston sleeve 82. The pressurized gases are used to move the ejection piston 78 to push the subvehicle 14 off of the subvehicle support 42 and away from the main missile body 12.

The retention rod 50 may be oriented radially relative to the subvehicle 14. That is, the retention rod 50 may have its axis perpendicular to a subvehicle axis 90. In addition the retention rod 50 may be substantially perpendicular to an axis of the main missile body 12. Preload stress may be provided on the retention rod 50 in order to reduce the amount of force from the cutter 70 that is required to sever the retention rod 50. The preload stress may be by suitable torquing of a fastener during assembly.

Figure 7:
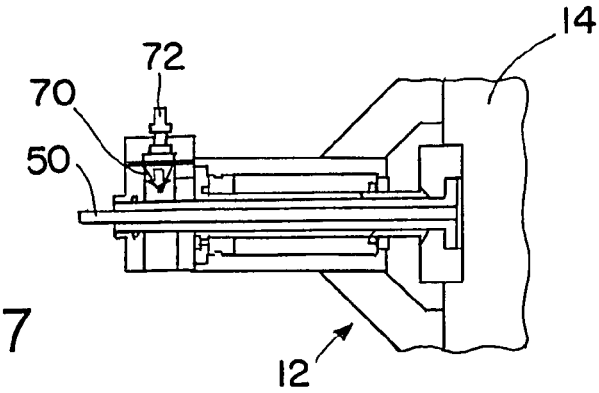
FIG. 7 is a cross-sectional view illustrating a first step in the operation of the part of the separation system shown in FIG. 5.

FIGS. 7-10 illustrate steps in the separation process for separating the subvehicle or submunition 14 from the main missile body 12. FIG. 7 shows the initiation of the separation process. The pyrotechnic system 72 is detonated producing pressurized gases which drive the cutter toward the retention rod 50 with great force.

Figure 8:
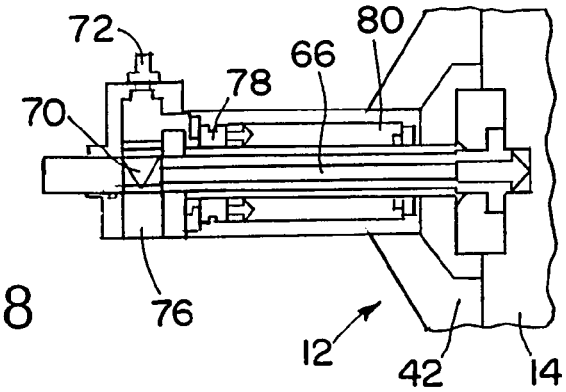
FIG. 8 is a cross-sectional view illustrating a second step in the operation of the part of the separation system shown in FIG. 5.

FIG. 8 shows the retention rod 50 severed, also severing cryogenic lines located in the through-hole 66 in the retention rod 50. After severing the retention rod 50, the cutter 70 comes to rest against the anvil 76. Movement of the cutter 70 also opens up the piston vent 86. This allows pressurized gases to enter into the piston cylinder 80. The pressurized gases cause movement of the eject piston 78. This pushes outward against the subvehicle 14 pressing against the subvehicle 14 in a direction to move it away from the subvehicle support. Since the retention rod 50 has been severed by the cutter 70, the subvehicle 14 is no longer firmly mechanically coupled to the main missile 12. Thus movement of the eject piston 78 causes movement in a similar direction by the subvehicle 14.

Figure 9:
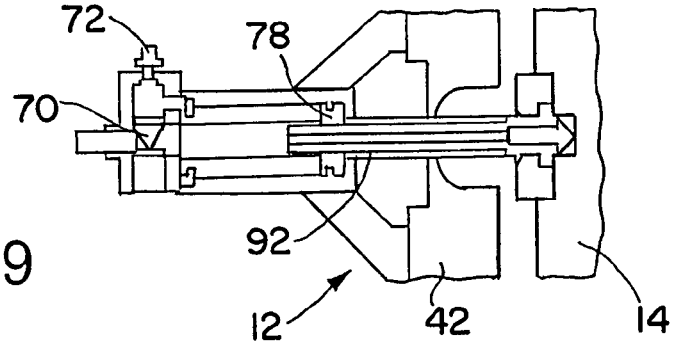
FIG. 9 is a cross-sectional view illustrating a third step in the operation of the part of the separation system shown in FIG. 5.
Figure 10:
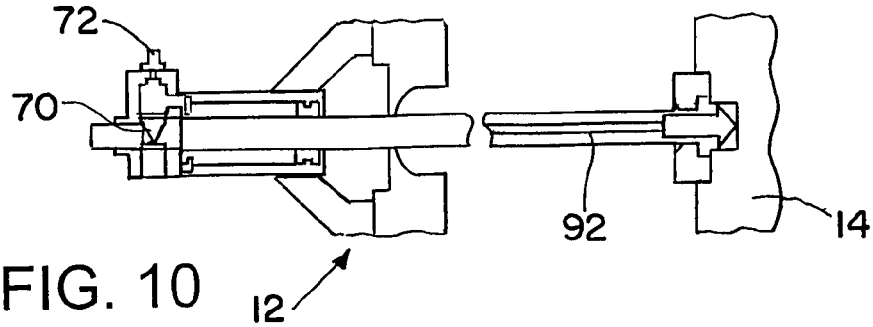
FIG. 10 is a cross-sectional view illustrating a fourth step in the operation of the separation system shown in FIG. 5.

FIG. 9 shows the continuation of this process, with further movement of the eject piston 78. This results in further force against the subvehicle 14, and acceleration of the subvehicle 14 in a direction away from the subvehicle support 42. Eventually the eject piston 78 reaches the end of its travel, at the end of the piston cylinder 80. At this point movement of the eject piston 78 stops. However, movement of the subvehicle 14 and the attached rod portion 92 continue, as illustrated in FIG. 10. This is because of the momentum already imparted to the subvehicle 14. Eventually the rod portion 92 that remains attached to the subvehicle 14 gets clear of the eject piston 78, fully removing any mechanical coupling or contact between the subvehicle 14 and the main missile body 12.

Figure 11:
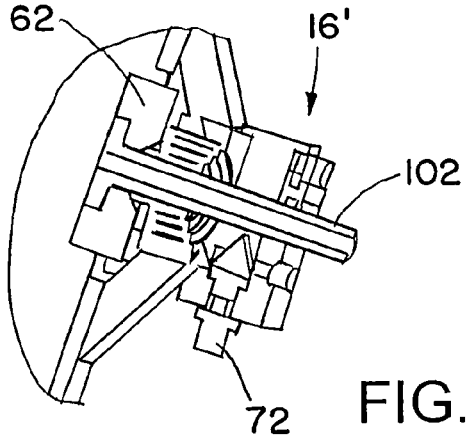
FIG. 11 is a cross-sectional view of part of another embodiment separation system in accordance with the present invention.
Figure 12:
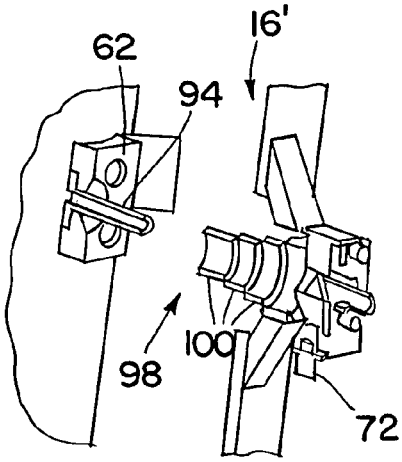
FIG. 12 is another view of the separation system of FIG. 11.
Figure 13:
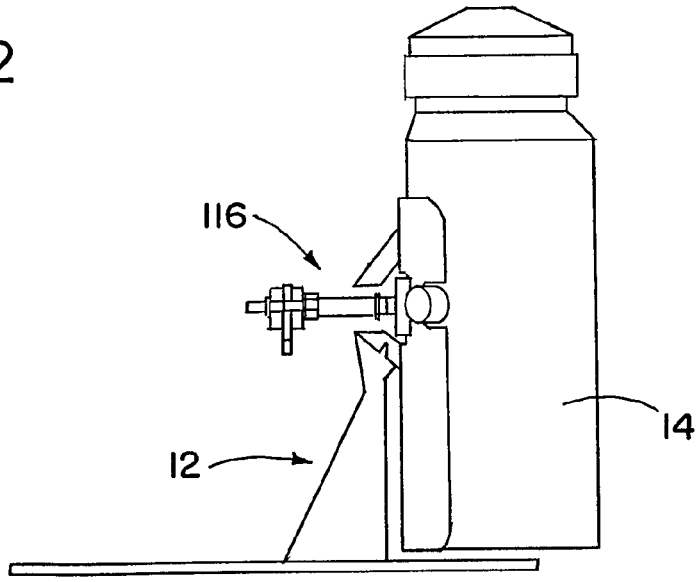
FIG. 13 is a side view of part of yet another embodiment separation system in accordance with the present invention.
Figure 14:
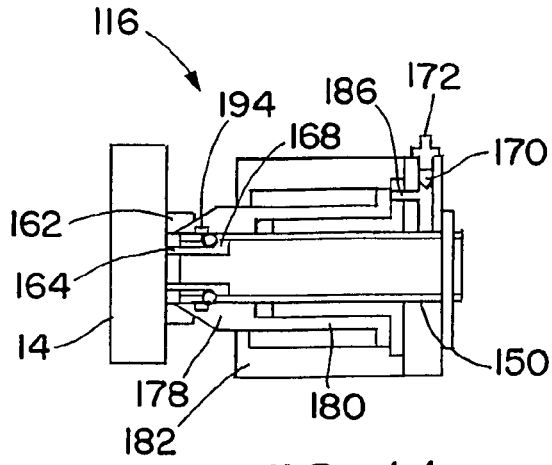
FIG. 14 is a cross-sectional view of a first step in the operation of the separation system of FIG. 13.

FIGS. 11 and 12 show an alternate embodiment arrangement that reduces the overall length of a rod portion 94 that is retained by the submunition 14 after separation. The separation system 16' shown in FIGS. 11 and 12 includes an expanding piston 98 having a series of nested segments 100. Upon introduction of pressurized gas from a pyrotechnic system 72, the expanding piston 98 expands, with the segments 100 moving relative to one another. This presses against the subvehicle bracket 62, pushing the subvehicle 14 away from the subvehicle support 42. The expanded piston 98 has an initial compressed state that has a length much less than that of the ejection mechanism 46 (FIG. 6). Thus a shorter retention rod 102 may be utilized, reducing the length of the retained rod portion 94.

FIGS. 13-16 show another alternate embodiment, a separation system 116 for separating the subvehicle 14 from the missile main body 12. The system 116 includes a ball lock mechanism. The separation system 116 has a retention rod 150 that is severed by a cutter 170 given by pressurized gases produced by a pyrotechnic device or system 172 (a pressurized gas source). Pressurized gases from the pyrotechnic device 172 are also used to move the piston 178. The pressurized gases proceed through a piston vent 186 into a space between a piston sleeve 182 and a piston cylinder 180, to engage the piston 178 there. Movement of the piston 178 causes the piston 178 to press outward against a fitting 162 on the subvehicle 14. The subvehicle 14 also has an additional fitting 164 that fits inside of the retaining rod 150. The fitting 164 has an outward-protruding lip 168. In the locked position shown in FIG. 14, with the subvehicle 14 engaged with the main missile body 12, the lip 168 is against a series of balls 174 that are in corresponding holes 178 in the retention rod 150. The balls 174 prevent the fitting 164 from disengaging with the retention rod 150. This is because the balls 174 prevent the protruding lip 168 from getting past them.

Figure 15:
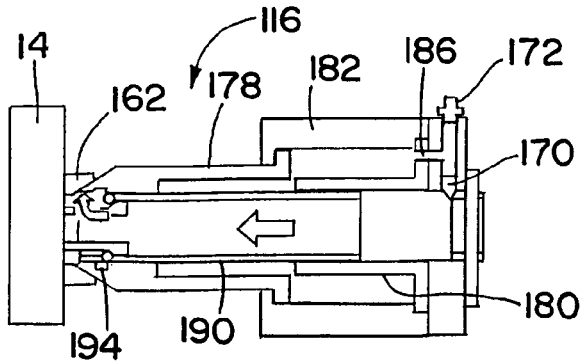
FIG. 15 is a cross-sectional view of a second step in the operation of the separation system of FIG. 13.

After firing of the pyrotechnic device 172 the retaining rod 150 is severed, as shown in FIG. 15. Pressurized gas passes through the piston vent 186 and pushes the piston 178 against the fitting 162. This pushes the subvehicle 14 away from the main missile body 12. Eventually the piston 178 reaches the end of its travel, which is the condition illustrated in FIG. 15.

Figure 16:
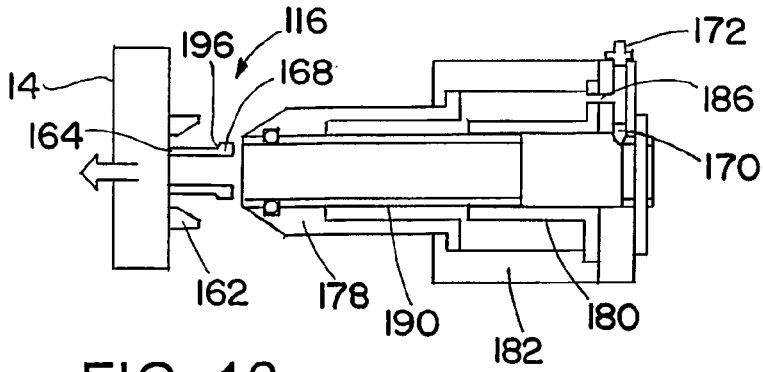
FIG. 16 is a cross-sectional view of a third step in the operation of the separation system of FIG. 13.

The subvehicle 14 continues to move away from the main missile 12, as illustrated in FIG. 16. Initially the severed retaining rod portion 190 is dragged along with the fitting 164 and the rest of the subvehicle 14. However, the balls 174 soon come to a position where they are aligned with a piston groove 194 in the piston 178. At this point ramped surfaces 196 of the fitting 164 urged the balls 174 outward. The balls 174 pass out of engagement with the protruding lip 168 and into the piston groove 194. This allows the fitting 164 to clear engagement with the retaining rod portion 190. Also, retaining rod portion 190 becomes locked to the piston 178. The result is that the subvehicle 14 proceeds out of engagement with the missile body 12 while leaving the retaining rod portion 190 with the main missile body 12. Only the fittings 162 and 164 protrude from the side of the main missile body. It will be appreciated that this may be a much smaller protrusion than that in other embodiments.

FIGS. 17-20 show a further embodiment, a separation system 216. The separation system 216 has a pyrotechnic charge or device (pressurized gas source) 272 for driving a cutter 270 into a retention rod 250, for severing the retention rod 250, in a manner similar to that of other systems described herein. The system 216 also includes an ejection piston 278 which operates with pressurized gas from the pyrotechnic charge 272 to push the subvehicle 14 away from the main missile body 12. It will be appreciated that many other parts of the system 216 are similar to corresponding parts of other systems described herein. Since operation of these parts of the system is similar to that of other embodiments described herein, further details regarding operation are omitted.

The system 216 has a pair of holes 280 and 282 in the cutter 270. Respective cryogenic lines 284 and 286 pass through the holes 280 and 282. Following of the pyrotechnic charge 272 causes rapid acceleration of the cutter 270 toward the retention rod 250. This shears off the portions of the cryogenic lines 284 and 286 that are in the holes 280 and 282. Thus, movement of the cutter 270 severs the cryogenic lines 284 and 286, which operate as shear pins.

The retention rod 250 has a notch or scoring 290 around its circumference. This reduced-thickness portion provides a preferential rotation for severing of the retention rod 250. The notch or scoring 290 may have any of a variety of configurations, for example being a scalloped notch or a V-shape notch.

The cutter 270 may have a concave surface 294 for impacting the retention rod 250. The concave surface 294 may advantageously minimize the impact area with the retention rod 250. It will be appreciated that the cutter 270 may have a variety of other tip shapes, such as blunt shapes or sharp shapes, in addition to the various specific shapes shown in other embodiments.

The cutter 270 may be made of steel. Material may be omitted from a slot or passage 296 in the cutter 270, in order to reduce weight of the cutter 270.

Various parts of the separation systems described herein may be made of suitable materials, such as steel. Alternate materials include titanium, INCONEL alloys, advanced ceramics, and corrosion resistant steel (CRES), or any mix of these high strength materials. For instance, the housing can be made of titanium to reduce weight since it is the largest component and the system is to be used on spacecraft, where weight optimization may be important. The cutter and retainer rod could remain steel or CRES (such as 17-4 stainless steel). Though to avoid any galvanic corrosion issues, it may be advantageous to minimize differing materials that may develop into a galvanic couple. It should be appreciated that the various features of the various embodiments disclosed herein may be combined in a single device, where possible.

It will be appreciated that many further variations are possible. The ejection mechanisms described herein by be used to eject miniaturized spacecraft or other subvehicles radially mounted to a central structure. The spacecraft or other subvehicles may be ejected or separated from the central structure at different velocities, at different times, or in different subgroupings. The pyrotechnic and other devices used for ejection may be sized or otherwise configured to release a single subvehicle or subset of the total number of space craft or other subvehicles at different ejection speeds. This would have the advantage of avoid collisions between spacecraft or other subvehicles during the ejection process, as well as potentially increasing are coverage of the ejected spacecraft or other subvehicles. Spreading of the spacecraft or other subvehicles may also be accomplished by temporally spacing the ejections in a desire sequence, with some ejections coming after others, for example with some pyrotechnic devices being fired only after one or more spacecraft or other subvehicles have been separated from the central structure.

Another variant is that the disengagement mechanisms described above as being part of a central structure (or missile main body) may instead be parts of the subvehicles that are separated from the main body. For example the pressurized gas sources and cutters may be parts of the subvehicles, rather than the missile main body. Use of a pressure source, such as a liquid divert and attitude control system (LDACS), from the subvehicles has the advantage of reducing spacecraft ejection shock loads. The LDACS is primarily used to steer the subvehicles, but may also be used as the pressure source for the ejection or separation system. Such a system is shown schematically in FIG. 21, which shows a missile 300 having spacecraft or subvehicles 302 that are initially coupled to a main missile body 304. A separation system 310 for separating the subvehicles 302 from the main missile body 304 relies on pressure sources 312, such as LDACS, that are part of the subvehicles 302. The pressure sources 312 may be used to drive respective cutters 314 that are also parts of the subvehicles 302.

Figure 21:
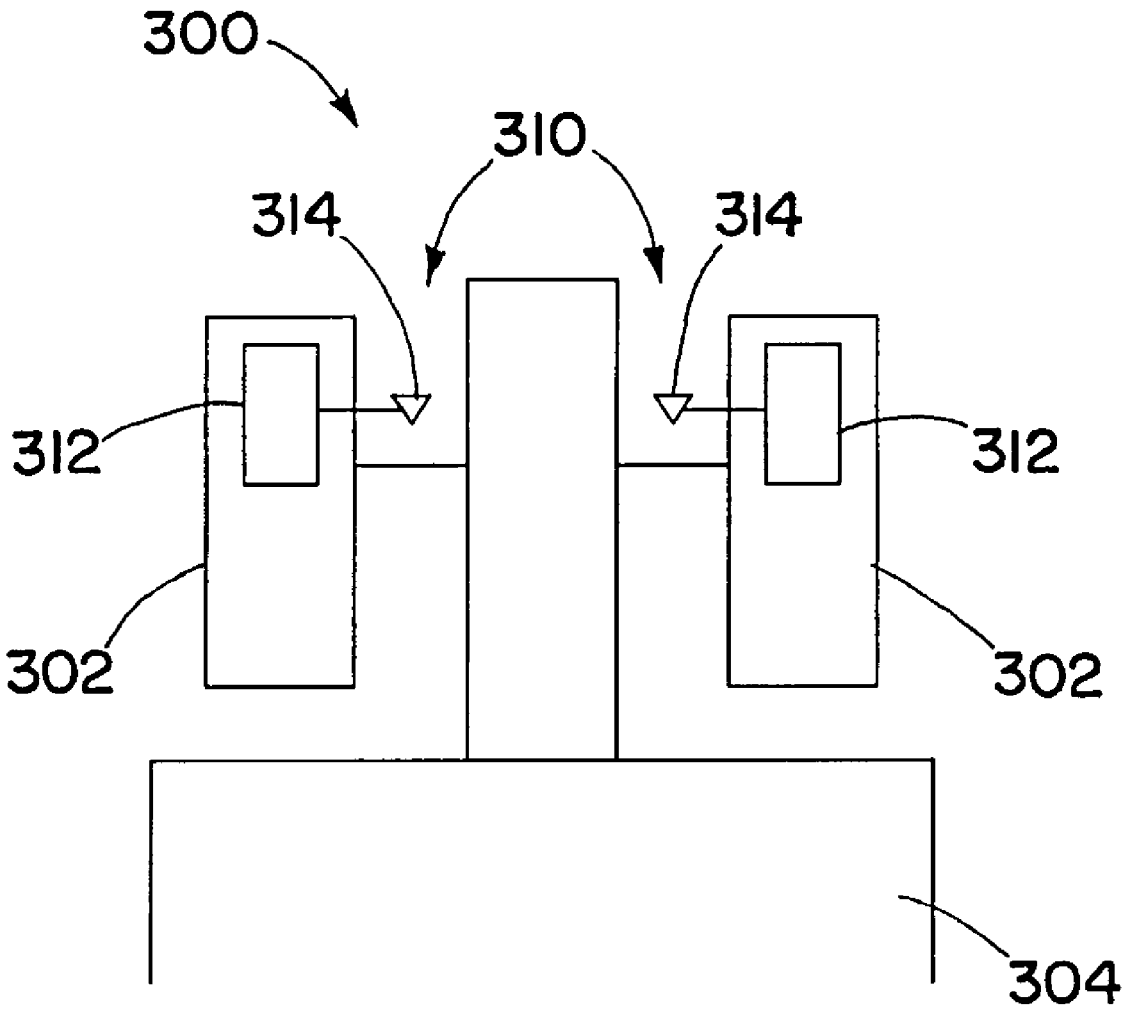
FIG. 21 is a schematic diagram of another embodiment separation system in accordance with an embodiment of the invention.

An additional advantage of the configuration shown in FIG. 21 is that deployment initiation may be reduced to a single command signal, such as a signal that would pressurize the LDACS propellant tanks and the ejection mechanism at the same moment). Spacecraft or other subvehicles could be individually deployed as required, such as for interception of multiple targets interception. Such a configuration may also use a required mechanism to cap the pressurant line after the ejection event has occurred, to prevent LDACS pressurant leakage.

Another advantage is excess LDACS pressurant gases can be used to further increase subvehicle deployment velocities as a cold gas thruster through the retention rod remnant, to further propel the subvehicles radially away from the main missile body, each at different speeds from the other spacecraft or subvehicles, to create a predetermined interception field for maximum targeting coverage. In this way the LDACS diverts would not have to be ignited at ejection when the spacecrafts are in close proximity to each other. This could reduce or eliminate the possibility of damaging or disabling a number of spacecrafts or subvehicles during initial fly out.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile comprising:

a missile main body;

one or more subvehicles initially mechanically coupled to the main body;

cryogenic lines connecting the missile main body and the one or more subvehicles; and a separation system that enables selective decoupling, during flight, of the one or more subvehicles from the main body;

wherein the separation system includes one or more pressurized gas sources that use pressurized gas 1) to mechanically decouple the one or more subvehicles from the missile main body, 2) to disconnect the cryogenic lines from the missile main body, and 3) to push the one or more subvehicles away from the missile main body.

2. The missile of claim 1, wherein the subvehicles are decoupled from the main body such that the subvehicles move in substantially radial directions away from the main body.

3. The missile of claim 1, wherein the pressurized gas source includes one or more of a pyrotechnic device, a gas generator, a pressure vessel, and one or more cryogenic bottles.

4. The missile of claim 1, wherein the separation system both 1) severs the cryogenic lines, and 2) releases mechanical couplings between the main body and the subvehicles.

5. The missile of claim 4, wherein the separation system releases the mechanical couplings by severing retention rods mechanically coupling the subvehicles to the main body.

6. The missile of claim 5, wherein the separation system includes pressure-driven cutters that each sever both one of the cryogenic lines and one of the retention rods.

7. The missile of claim 5, wherein the cryogenic lines pass through the retention rods.

8. The missile of claim 5, wherein the retentions rods are scored to facilitate severing.

9. The missile of claim 8, wherein the retention rods are enclosed in sleeves.

10. The missile of claim 5, wherein the retention rods are substantially perpendicular to respective axes of the subvehicles.

11. The missile of claim 4, wherein the mechanical couplings include ball locks that are released using the pressurized gas.

12. The missile of claim 1, wherein the separation system separates all of the subvehicles with a single shock from a single initiation event.

13. The missile of claim 1, wherein the one or more subvehicles includes multiple subvehicles.

14. The missile of claim 13, wherein each of the one or more pressurized gas sources both mechanically decouples one or more of the multiple subvehicles, and disconnects the cryogenic lines from the missile main body to the one or more of the multiple subvehicles.

15. The missile of claim 1, wherein the one or more pressure sources are part of the one or more subvehicles.

16. The missile of claim 15, wherein the separation system also includes one or more pressure-driven cutters coupled to the one or more pressure sources; and wherein the one or more cutters are part of the one or more subvehicles.

17. A missile comprising:

a missile main body;

one or more subvehicles initially coupled to the main body; and a separation system that enables selective decoupling during flight of the subvehicles from the main body;

wherein the separation system includes one or more pressure-driven cutters for severing mechanical couplings between the subvehicles and the main body.

18. The missile of claim 17, wherein the one or more cutters are parts of the one or more subvehicles.

19. A missile comprising:

a missile main body;

multiple subvehicles initially coupled to the main body; and a separation system that enables selective decoupling during flight of the subvehicles from the main body;

wherein the separation system includes a single pressurized gas source that provides a single shock in the process of separating the subvehicles.

20. The missile of claim 19, wherein the separation also separates cryogenic lines between the missile main body and the subvehicles, using energy from the single pressurized gas source.

21. A method of separating subvehicles of a missile from a missile main body, the method comprising:

disconnecting cryogenic lines connecting the missile main body and the subvehicles, using pressurized gas from one or more pressurized gas sources;

mechanically decoupling and separating the subvehicles from the missile main body, using the pressurized gas; and pushing the subvehicles away from the main body using force from the pressurized gas.

22. The method of claim 21, wherein the pushing the subvehicles away from the main body includes moving the subvehicles in substantially radial directions.

23. The method of claim 21, wherein the disconnecting includes severing the cryogenic lines by movement of cutters driven by the pressurized gas.

24. The method of claim 23, wherein the mechanically decoupling includes severing with the cutters members that mechanically couple the subvehicles and the missile main body.

25. The method of claim 24, wherein the members include retention rods severed by the cutters.

* * * * *